US010900478B2

(12) United States Patent
Diez Diaz et al.

(10) Patent No.: US 10,900,478 B2
(45) Date of Patent: Jan. 26, 2021

(54) PUMP MEMBRANE FOR DIAPHRAGM PUMP

(71) Applicant: DÄTWYLER SCHWEIZ AG, Schattdorf (CH)

(72) Inventors: Maria Del Mar Diez Diaz, Freienbach (CH); Rudolf Randler, Dallenwil (CH); Raphael Kälin, Hergiswil (CH); Norbert Haberland, Euskirchen (DE)

(73) Assignee: DÄTWYLER SCHWEIZ AG, Schattdorf (CH)

( * ) Notice: Subject to any disclaimer, the term of this patent is extended or adjusted under 35 U.S.C. 154(b) by 0 days.

(21) Appl. No.: 16/337,474

(22) PCT Filed: Sep. 21, 2017

(86) PCT No.: PCT/EP2017/073841
§ 371 (c)(1),
(2) Date: Mar. 28, 2019

(87) PCT Pub. No.: WO2018/060034
PCT Pub. Date: Apr. 5, 2018

(65) Prior Publication Data

US 2019/0226469 A1 Jul. 25, 2019

(30) Foreign Application Priority Data

Sep. 29, 2016 (CH) ..... 1282/16

(51) Int. Cl.
*F04B 43/02* (2006.01)
*F04B 15/02* (2006.01)
*F04B 43/00* (2006.01)

(52) U.S. Cl.
CPC ..... *F04B 43/021* (2013.01); *F04B 15/02* (2013.01); *F04B 43/0054* (2013.01);
(Continued)

(58) Field of Classification Search
CPC ..... F04B 3/031; F04B 15/02; F04B 43/0054
See application file for complete search history.

(56) References Cited

U.S. PATENT DOCUMENTS 6,055,898 A 5/2000 Rinninger
6,935,180 B2 8/2005 Weisbrodt
(Continued)

FOREIGN PATENT DOCUMENTS

DE 296 12 117 U1 9/1996
DE 198 29 084 A1 1/2000
(Continued)

OTHER PUBLICATIONS

International Preliminary Report on Patentability dated Apr. 2, 2019 and Written Opinion for PCT/EP2017/073841 filed Sep. 21, 2017.
(Continued)

*Primary Examiner* — Thomas E Lazo
*Assistant Examiner* — Daniel S Collins
(74) *Attorney, Agent, or Firm* — Paul D. Bianco; Gary S. Winer; Fielt intellectual Property Law

(57) ABSTRACT

A pump diaphragm for a diaphragm pump for conveying a fluid includes a solid core with a connection device for a drive rod of the diaphragm pump, and a plate-shaped elastic diaphragm body made of rubber having a peripheral clamping edge. The solid core is embedded at least partially in the diaphragm body and the solid core is produced from a thermoplastic and forms covalent bonds with the elastic diaphragm body made of rubber without adhesive. For this purpose, the thermoplastic, for example polyamide 612 or polyphenylene ether, and the rubber, a periodically cross-linked rubber such as EPDM, are selected in such a way that they are covalently cross-linked with one another at the boundary layer. In this way, a bonding layer that is suscep-
(Continued)

tible to weakening or destruction is not present between the core and the diaphragm body.

20 Claims, 2 Drawing Sheets

(52) U.S. Cl.
CPC ..... *F04B 43/02* (2013.01); *F05C 2225/02* (2013.01); *F05C 2225/06* (2013.01); *F05C 2225/08* (2013.01)

(56) References Cited

U.S. PATENT DOCUMENTS

| | | | | |
|---|---|---|---|---|
| 7,905,172 | B2 | 3/2011 | Öhrle et al. | |
| 9,057,366 | B2 | 6/2015 | Becker et al. | |
| 10,422,331 | B2 * | 9/2019 | Ezzo | F04B 43/0054 |
| 2011/0311379 | A1 | 12/2011 | Hale et al. | |

FOREIGN PATENT DOCUMENTS

| | | | |
|---|---|---|---|
| DE | 100 58 274 | A1 | 5/2002 |
| DE | 10 2010 009670 | A1 | 9/2011 |
| EP | 1 479 910 | A2 | 11/2004 |
| EP | 1 892 414 | A1 | 2/2008 |

OTHER PUBLICATIONS

International Search Report dated Nov. 30, 2017 for PCT/EP2017/073841 filed Sep. 21, 2017.
Written Opinion for PCT/EP2017/073841 filed Sep. 21, 2017.

* cited by examiner

PUMP MEMBRANE FOR DIAPHRAGM PUMP

TECHNICAL FIELD

The invention relates to a pump diaphragm, in particular a metering pump diaphragm, for a diaphragm pump for conveying a fluid.

TECHNICAL BACKGROUND

A diaphragm pump for conveying fluids comprises as an essential element a pump diaphragm, which comprises a circular functional region and a peripheral clamping edge surrounding the function region. It is fastened in the diaphragm pump by the clamping edge. The drive of the pump is separated by the pump diaphragm from the fluid in the pump chamber. In order to convey the fluid, the circular functional region of the pump diaphragm in the operating state is deflected or driven either hydraulically, pneumatically, mechanically or electromechanically essential along a longitudinal axis running through the centre of the functional region.

Mechanically driven pump diaphragms typically comprise a flexible diaphragm body made of rubber and, partially embedded therein, a solid core with a connection means for the drive. The solid core is in most cases driven by an electric motor via a drive rod and a cam. The pumping effect is then achieved by the periodic deflection of the pump diaphragm or of the circular functional region of the pump diaphragm essentially along the longitudinal axis of the pump diaphragm running through the centre of the functional region, i.e. the deflection is not exactly axial, but rather the pump diaphragm usually experiences, depending on the geometric embodiment of the driving components, also a lateral or wobbling deflection.

With the known, mechanically driven pump diaphragms, e.g. from US2011311379, the solid core is produced from metal or plastic and provided with an adhesive agent, which forms a more or less solid bonding layer between the core and the rubber of the diaphragm body. Such pump diaphragms are used, amongst other things, in metering pumps, for example for dialysis machines, in which a specific, constant fluid volume must be conveyed in each pump cycle.

It has been shown by the applicant in tests that, for example in the case of pump diaphragms which are used in dialysis machines, the conveyed media, e.g. also disinfectants used in the cleaning of the pump, can defuse over time through the rubber into the boundary layer between the core and the diaphragm body and slowly destroy the bonding layer and thus weaken the bond between the core and diaphragm body over time. This then leads to increasing inaccuracies of the pump volume, because the core is no longer firmly anchored in the diaphragm body and, with the retraction of the core, the flexible diaphragm body is no longer moved back uniformly and completely. The progressive destruction of the bond between the core and the diaphragm body finally leads to complete failure of the pump diaphragm or to the loss of the pump power.

The same problem also exists with diaphragm pumps for conveying aggressive fluids, such as for example solvents or solvent-containing fluids. Also in the case of pump diaphragms which are operated with very relatively high frequencies of 50 Hz or over, the heavy burden can lead to increasing destruction of the bond between the core and the diaphragm body.

A solution is known from EP1892414, wherein the pump diaphragm is provided on the fluid side with a barrier layer constituted as a permeation barrier. Such a pump diaphragm, however, has a much more complex structure and is correspondingly expensive in production.

SUMMARY OF THE INVENTION

One aspect of the disclosure relates to a pump diaphragm, wherein a weakening or destruction of the bond between the core and the diaphragm body is prevented or at least significantly retarded, and so a time-dependent change in the delivery volume does not occur or is at least markedly retarded.

The pump diaphragm for a diaphragm pump for conveying a fluid comprises a solid core with a connection means for a drive rod of the diaphragm pump and a plate-shaped, elastic diaphragm body made of rubber with a peripheral clamping edge. The solid core is at least partially embedded in the diaphragm body. Furthermore, the solid core is produced from a thermoplastic and forms covalent bonds with the elastic diaphragm body made of rubber without adhesive.

That is to say that the thermoplastic and the rubber are selected such that, in the production of the pump diaphragm, they enter at their boundary layer with one another into a direct, adhesive-free chemical plastic-rubber bond or the plastic and the rubber are covalently cross-linked with one another at the boundary layer. A bonding layer susceptible to weakening or destruction between the core and the diaphragm body is not therefore present.

In order to produce such a pump diaphragm, the core is first produced from plastic and then the rubber is vulcanised directly on the core. In the vulcanisation of the rubber, the covalent bonds also arise at the boundary layer between the plastic and the rubber.

Preferred embodiments of the invention are also disclosed.

In some embodiments, the rubber can be a peroxidically cross-linked rubber, in particular peroxidically cross-linked ethylene-propylene-diene rubber (EPDM).

In some embodiments, the plastic can be a polyamide 612 or a polyphenylene ether, in particular poly-2,6-dimethyl-1,4-phenylene ether.

Particularly suitable plastic-rubber material pairings are: polyamide 612 (such as marketed for example under the trade name Vestamid DX 9325 "ISO 1874-1 PA612, MH, 14-100, GF40" by Evonik Industries AG) or polyphenylene ether, in particular poly-2,6-dimethyl-1,4-polyphenylene ether (such as for example marketed under the trade name Vestoran 1900 GF20 by Evonik Industries AG) together with a peroxidically cross-linked ethylene-propylene-diene rubber (EPDM).

In some embodiments, the rubber can be a silicone rubber or a fluorosilicone rubber (MVQ/FMQV) and the plastic can be a polybutylene terephthalate (PBT).

Apart from the improved chemical anchoring of the core inside the diaphragm body, the core can also comprise an optimised shape for a mechanical anchoring, as is explained below. Both the features of the chemical and of the mechanical anchoring can also be regarded as independent inventions, which solve the same problem of improved functionality and durability. The combination of the chemical anchoring with the mechanical anchoring described below displays however a synergetic effect, in that the overall surface of the boundary layer between the core and the diaphragm body is significantly enlarged by the features of the mechanical anchoring.

In some embodiments, the solid core can comprise a plate-shaped anchoring plate with a plurality of through-holes. The through-holes are usually arranged in a circular manner around the longitudinal axis of the pump diaphragm. A particularly good mechanical anchoring of the diaphragm body to the core can be achieved by the fact that the through-holes in each case have at least one constriction of the cross-section, as viewed from the side facing away from the fluid in the direction of the side facing the fluid. The force from the core is thus transferred better to the diaphragm body during a traction movement of the drive.

The constriction can be constituted as a peripheral shoulder or flange and usually starts roughly in the middle in the through-hole. The peripheral shoulder or flange can comprise interruptions, so that the constriction is formed by a plurality of elongated ribs. The constriction can also be constituted by a conical through-hole.

The anchoring plate can be at least partially embedded in the diaphragm body, wherein it is completely covered on the fluid side by the diaphragm body. On the side facing away from the fluid, it can be partially exposed, i.e. not completely covered by the diaphragm body.

In some embodiments, the solid core can comprise a plate-shaped anchoring plate, which comprises an annular groove at the side facing away from the fluid, in which groove a plurality of through-holes are arranged. This groove and the through-holes are completely filled with the diaphragm body in the case of the pump diaphragm. When there is a traction movement of the drive, the force from the core is thus transferred better to the diaphragm body.

Furthermore, a radially outer wall of the groove can have a smaller height than a radially inner wall, so that a peripheral edge of the anchoring plate is completely surrounded by the diaphragm body.

The annular groove can be combined with the through-holes with a constriction arranged in a circular form as described above.

In some embodiments, the core can comprise a peg, at the end whereof facing away from the fluid the connection means is arranged. The peg can comprise a central blind hole at the side facing the fluid, which is filled by the diaphragm body.

In some embodiments, the connection means can be a metallic threaded insert. The latter can be injection moulded directly with the core. Alternatively, the connection means can also be constituted in one piece with the core.

BRIEF EXPLANATION OF THE FIGURES

The invention will be explained in greater detail below with the aid of examples of embodiment in conjunction with the drawing(s). In the figures.

WAYS OF PERFORMING THE INVENTION

Figure 1:
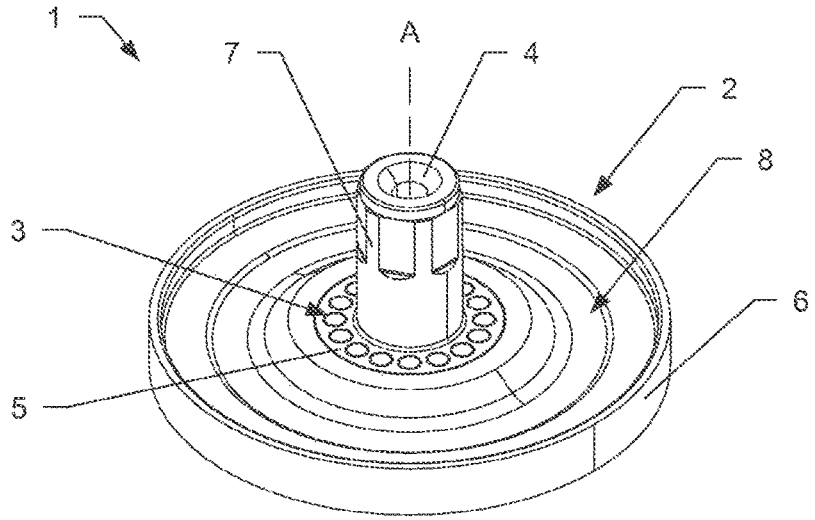
FIG. 1 shows a perspective view onto the side of a pump diaphragm facing away from the fluid comprising a solid core and an elastic diaphragm body.
Figure 2:
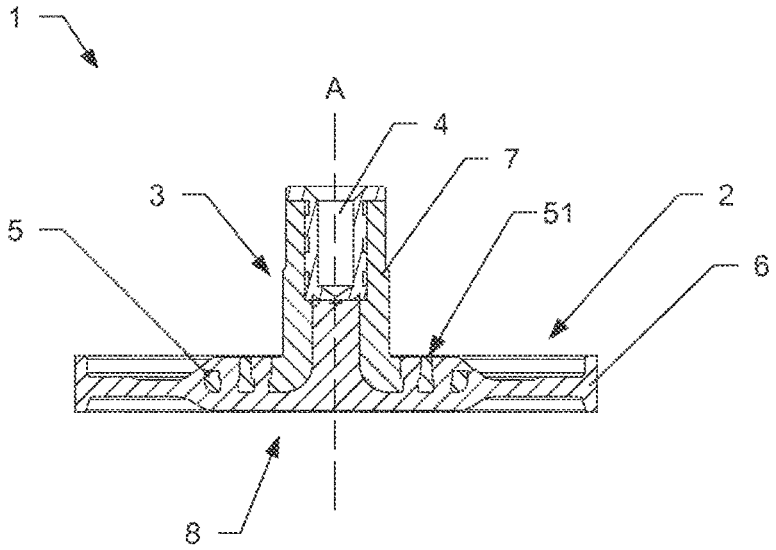
FIG. 2 shows a cross-sectional representation of the pump diaphragm.

FIG. 1 shows a perspective view of a pump diaphragm 1 for a diaphragm pump, in particular a metering diaphragm pump, for conveying a fluid. FIG. 2 shows a cross-sectional representation through the pump diaphragm from FIG. 1. Pump diaphragm 1 comprises a plate-shaped, elastic diaphragm body 2 made of rubber with a circular functional region 8 and a peripheral clamping edge 6 encircling a longitudinal axis A of pump diaphragm 1. Longitudinal axis A runs through the centre of circular functional region 8 and parallel to the deflection direction of pump diaphragm 1. Pump diaphragm 1, in the installed state, is held in a sealing manner with clamping edge 6 in a pump housing to delimit a pump chamber in which the fluid to be pumped flows. In the embodiment shown, clamping edge 6 is formed T-shaped in cross-section. Other shapes are also possible.

Furthermore, pump diaphragm 1 comprises a solid core 3, which is at least partially embedded in diaphragm body 2 and on the fluid side, i.e. towards the pump chamber, is completely covered by diaphragm body 2. On the side facing away from the fluid, core 3 comprises a connection means 4, which can be in an operative connection with the drive of the diaphragm pump for deflecting pump diaphragm 1 along longitudinal axis A.

For the chemical anchoring of core 3 in diaphragm body 2, core 3 is produced in one piece from a thermoplastic, which forms covalent bonds with elastic diaphragm body 2 made of rubber without adhesive. The thermoplastic can be a polyamide 612 or a polyphenylene ether, in particular poly-2,6-dimethyl-1,4-phenylene ether, which enters into covalent bonds with peroxidically cross-linked rubber, preferably peroxidically cross-linked ethylene-propylene-diene rubber (EPDM). The covalent bonds arise during the vulcanisation of the rubber.

Alternatively, a silicone rubber or a fluorosilicone rubber (MVQ/FMQV) can be used as rubber and a polybutylene terephthalate (PBT) as plastic.

For the mechanical anchoring, core 3 comprises an anchoring plate 5, which is covered at least partially by diaphragm body 2 at the side facing away from the fluid. In the shown embodiment, core 3 also comprises a peg 7, and connection means 4 is not arranged directly in anchoring plate 5, but rather at the end of peg 7 facing away from the fluid.

Furthermore, in the shown embodiment, connecting means 4 is fixed in the core as a separate part, e.g. in the form of a threaded insert. Peg 7 can also be constituted polygonal at the end facing away from the fluid, so that it can be screwed tight to the drive rod using an Allen key.

Pump diaphragm 1 can be produced by injection moulding technology, for example by a two-component injection moulding process, in which first the solid core and then diaphragm body 2 are injected. A metallic connection means 4, e.g. in the form of a threaded insert, can be injection moulded directly with the core material.

Figure 3:
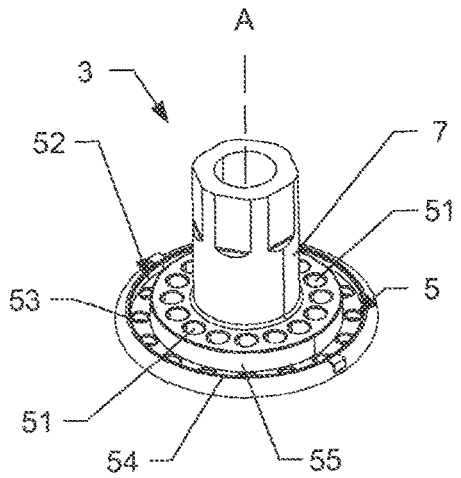
FIG. 3 shows a perspective view onto the side of a solid core of the pump diaphragm that is facing away from the fluid.
Figure 4:
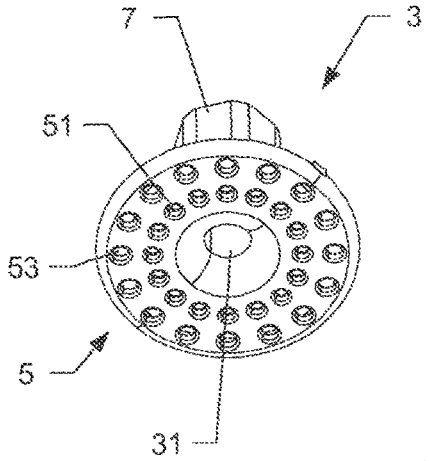
FIG. 4 shows a perspective view onto the side of the solid core facing the fluid.
Figure 5:
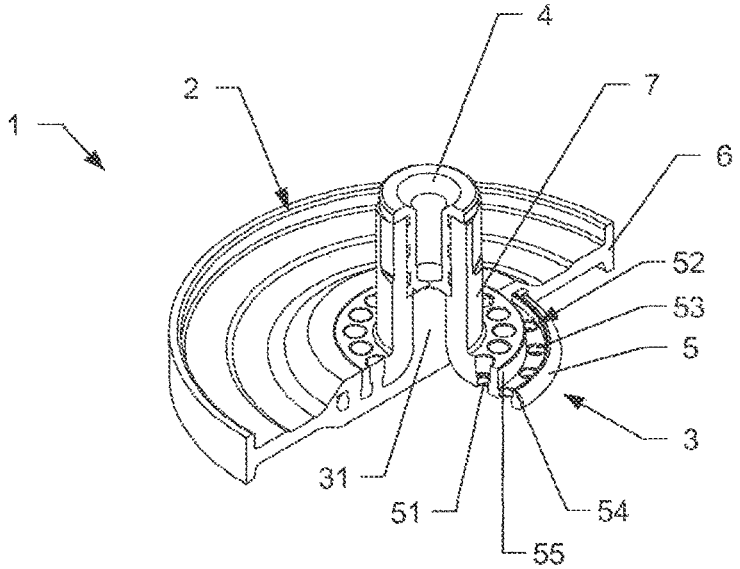
FIG. 5 shows a perspective partially cross-sectional representation of the pump diaphragm.

FIG. 3 and FIG. 4 show a perspective exploded view onto solid core 3 on the side facing away from the fluid and the side facing the fluid. FIG. 5 shows a perspective partially cross-sectional representation of pump diaphragm 1 from FIGS. 1 and 2 with the core from FIGS. 3 and 4. Anchoring plate 5 comprises an inner ring comprising a plurality of inner through-holes 51 arranged around longitudinal axis A. As can be seen in FIG. 2 and in FIG. 5, inner through-holes 51 for the mechanical anchoring of core 3 in diaphragm body 2 in each case comprise a circumferential shoulder, so that they are constricted on the fluid side. Inner through-holes 51 of anchoring plate 5 are filled, in finished pump diaphragm 1, completely with the rubber of the diaphragm body. As additional mechanical anchoring, anchoring plate 5 also comprises on the side facing away from the fluid an annular groove 52, in which an outer ring comprising a plurality of outer through-holes 53 is arranged. In addition, in the example of embodiment shown, outer wall 54 of groove 52 has a smaller height than inner wall 55 of groove 52, so that, in finished pump diaphragm 1, diaphragm body 2 surrounds the peripheral edge of anchoring plate 5 with its outer wall 54 and completely fills groove 52 together with outer through-holes 53.

Furthermore, core 3 comprises a central opening 31 on the fluid side, which together with the connection means constitutes a blind hole. It finished pump diaphragm 1, this blind hole is also filled with the rubber of diaphragm body 2. The described structures of core 2 (through-holes, groove, blind hole) all lead to an enlargement of the bonding area between core 3 and diaphragm body 2, which, particularly in the case of the previous described chemical anchoring, leads to a much more durable and stronger fastening of core 3 in diaphragm body 2.

REFERENCE LIST 1 pump diaphragm
2 diaphragm body
3 core
4 connection means
5 anchoring plate
6 clamping edge
7 peg
8 functional region
31 central opening/central blind hole
51 inner through-holes
52 annular groove
53 outer through-holes
54 outer wall
55 inner wall
A longitudinal axis

The invention claimed is:

1. A pump membrane for a diaphragm pump comprising:
an elastic body composed of a rubber material and shaped as a plate, the elastic body having a peripheral clamping edge configured for fastening with the diaphragm pump;
a core composed of a thermoplastic material and at least partially embedded into the elastic body; and
a connection member configured for operatively connecting with a drive rod of the diaphragm pump;
wherein the thermoplastic material of the core is covalently bonded with the rubber material of the elastic body free of adhesive, and
wherein the thermoplastic material and the rubber material are selected such that the thermoplastic material and the rubber material are covalently cross-linked with one another at the boundary layer.

2. The pump membrane according to claim 1, wherein the core further comprises an anchoring plate having a plurality of through-holes circularly arranged around a longitudinal axis of the pump membrane, the plurality of through-holes having a constriction of cross section viewed from a side of the pump membrane facing away from fluid in a direction of a side facing fluid.

3. The pump membrane according to claim 1, wherein the core further comprises an anchoring plate having an annular groove in a side facing away from fluid and a plurality of through-holes arranged in the annular groove.

4. A pump membrane for a diaphragm pump comprising:
an elastic body composed of a rubber material and shaped as a plate, the elastic body having a peripheral clamping edge configured for fastening with the diaphragm pump;
a core composed of a thermoplastic material and at least partially embedded into the elastic body; and
a connection member configured for operatively connecting with a drive rod of the diaphragm pump;
wherein, during production of the diaphragm pump, the rubber material of the elastic body is vulcanized on the thermoplastic material of the core such the rubber material and the thermoplastic material are covalently cross linked at a boundary layer formed between the elastic body and the core, and
wherein the thermoplastic material and the rubber material are selected such that the thermoplastic material and the rubber material are covalently cross-linked with one another at the boundary layer free of adhesive.

5. The pump membrane according to claim 4, wherein the rubber material of the elastic body is a peroxidically cross-linked rubber and the thermoplastic material of the core is a polyamide 612 or a polyphenylene ether.

6. The pump membrane according to claim 5, wherein the peroxidically crosslinked rubber is a peroxidically cross-linked ethylene-propylene-diene rubber (EPDM) and the polyphenylene ether is poly-2,6-dimethyl-1,4-phenylene ether.

7. The pump membrane according to claim 4, wherein the rubber material of the elastic body is a silicone rubber or a fluorosilicone rubber (MVQ/FMQV) and the thermoplastic material of the core is a polybutylene terephthalate (PBT).

8. The pump membrane according to claim 4, wherein the connection member is a threaded insert composed of a metallic material.

9. The pump membrane according to claim 4, wherein the core further comprises an anchoring plate having a plurality of through-holes circularly arranged around a longitudinal axis of the pump membrane, the plurality of through-holes having a constriction of cross section viewed from a side of the pump membrane facing away from fluid in a direction of a side facing fluid.

10. The pump membrane according to claim 4, wherein the core further comprises an anchoring plate having an annular groove in a side facing away from fluid and a plurality of through-holes arranged in the annular groove.

11. A metering pump for conveying a fluid having the pump membrane according to claim 4.

12. A pump membrane for a diaphragm pump comprising:
an elastic body composed of a rubber material and shaped as a plate, the elastic body having a peripheral clamping edge configured for fastening with the diaphragm pump;
a core composed of a thermoplastic material and at least partially embedded into the elastic body;
a peg extending upwardly from a surface of the core; and
a connection member arranged at an end of the peg away from the surface of the core, the connection member configured for operatively connecting with a drive rod of the diaphragm pump;
wherein, during production of the diaphragm pump, the rubber material of the elastic body is vulcanized on the thermoplastic material of the core such the rubber material and the thermoplastic material are covalently cross linked at a boundary layer formed between the elastic body and the core.

13. The pump membrane according to claim 12, wherein the peg comprises a central opening.

14. The pump membrane according to claim 12, wherein the rubber material of the elastic body is a peroxidically crosslinked rubber and the thermoplastic material of the core is a polyamide 612 or a polyphenylene ether.

15. The pump membrane according to claim 14, wherein the peroxidically crosslinked rubber is a peroxidically crosslinked ethylene-propylene-diene rubber (EPDM) and the polyphenylene ether is poly-2,6-dimethyl-1,4-phenylene ether.

16. The pump membrane according to claim 12, wherein the rubber material of the elastic body is a silicone rubber or a fluorosilicone rubber (MVQ/FMQV) and the thermoplastic material of the core is a polybutylene terephthalate (PBT).

17. The pump membrane according to claim 12, wherein the connection member is a threaded insert composed of a metallic material.

18. The pump membrane according to claim 12, wherein the core further comprises an anchoring plate having a plurality of through-holes circularly arranged around a longitudinal axis of the pump membrane, the plurality of through-holes having a constriction of cross section viewed from a side of the pump membrane facing away from fluid in a direction of a side facing fluid.

19. The pump membrane according to claim 12, wherein the core further comprises an anchoring plate having an annular groove in a side facing away from fluid and a plurality of through-holes arranged in the annular groove.

20. A metering pump for conveying a fluid having the pump membrane according to claim 12.

* * * * *